182-145 SR

7/1/85 XR 4,597,471

United States Patent [19]

Anderson

[11] Patent Number: 4,597,471

[45] Date of Patent: Jul. 1, 1986

[54] HEAVY DUTY PUMP JACK

[76] Inventor: Carl E. Anderson, 12 St. Stephens Pl., Staten Island, N.Y. 10306

[21] Appl. No.: 714,932

[22] Filed: Mar. 22, 1985

[51] Int. Cl.[4] ..... E04G 1/20

[52] U.S. Cl. ..... 182/136; 182/132; 182/145; 248/246

[58] Field of Search ..... 248/235, 246, 245, 244; 182/130–136, 141, 145, 123, 143, 122, 148, 223, 121, 149

[56] References Cited

U.S. PATENT DOCUMENTS

| | | | |
|---|---|---|---|
| 890,804 | 6/1908 | Shears | 248/246 |
| 1,366,487 | 1/1921 | Pitou | 182/130 |
| 1,441,806 | 1/1923 | Hoitsma | 182/136 |
| 2,424,115 | 7/1947 | Powell | 182/136 |
| 3,340,961 | 9/1967 | Provaznik | 182/134 |
| 4,382,488 | 5/1983 | Anderson | 182/145 |
| 4,407,418 | 10/1983 | Brammer | 248/298 |
| 4,463,828 | 8/1984 | Anderson | 182/136 |

*Primary Examiner*—Reinaldo P. Machado
*Assistant Examiner*—Alvin Chin-Shue

[57] ABSTRACT

A pump jack arrangement for traveling up and down a pole including a frame member upper and lower shackle members supported by the frame member. A pump arm and a support arm are provided for supporting weights The pump arm is utilized for causing the shackle members to alternately grip the pole. The non-gripping shackle member is stepped upwardly along the pole. The upper and lower shackles include pivotally interconnected yoke members and linkage members which are pivotally connected utilizing the rear gripping rod of the yoke member itself as the pivot. The pump jack is formed of U-shaped channels in order to provide additional supports. The support arms themselves also comprise opposingly interfitted U-shaped channels to provide a slidable support arm. A guard plate is provided over the front gripping rod of the upper shackle.

20 Claims, 13 Drawing Figures

HEAVY DUTY PUMP JACK

RELATIONSHIP TO OTHER APPLICATIONS

This invention relates to the following issued U.S. applications all by the inventor of the present application. U.S. Pat. No. 4,382,488 issued May 10, 1983 for Pump Jack Poles; and U.S. Pat. No. 4,463,828 issued Aug. 7, 1984 for a Pump Jack.

BACKGROUND OF THE INVENTION

This invention relates to scaffolding systems, and more particularly to a pump jack for traveling up and down a pole.

In numerous industries, it is necessary to erect scaffolding both internally as well as externally in order to permit workers to stand at an elevation above ground surface. Typically, a scaffolding system is utilized in the installation of aluminum siding on the exterior of housing. Such scaffolding is typically erected by utilizing pump jack poles which are spaced apart and secured in spaced relationship to the house by means of a brace. Pump jacks are used to ride up and down the poles. The pump jacks typically include support arms on which are extended scaffolding staging. The workers can stand on the scaffolding staging and operate the pump jack to move the staging up and down along the pump jack poles.

Typically a pump jack includes a frame with an upper and lower shackle member supported by the frame. A pump arm is pivotally provided onto the frame which operates the shackles in alternating relationship. The pump arm serves to have the upper shackle in a twist gripping relationship securing onto the pole while it then serves to raise up the frame to step it upward along the pole. The weight then shifts so that the lower shackle twist grips the pole and the upper shackle steps up to a next position on the pole. In this manner, the non-gripping shackle steps up the pole while the opposing shackle grips the pole. To ride the pump jack down the pole, the lower shackle is released from its gripping relationship and the upper shackle is rolled down the pole by means of a handle.

The aforementioned U.S. Pat. No. 4,382,488 described a novel pump jack pole formed of elongated hollow metal with a rubberized surface on only one side of the pole. Such poles were found to be extremely strong, longlasting and easier to manipulate than the standard wooden poles. The aforementioned U.S. Pat. No. 4,463,828 described an improved pump jack which includes features to improve the safety of the pump jack as well as its strength. Such features include the ability to release one of the shackles by means of a foot release pedal avoiding the necessity of bending over and releasing the lower shackle by hand. The patent also described an over-the-center spring loaded handle used to control the rolling down of the pump jack.

The aforementioned features provided in the pump jack have truly served to improve such pump jacks in the industry. Nevertheless additional safety measures are always warranted with respect to the pump jack. For example, the spiral rod utilized to control rolling down of the pump jack along the pump jack pole has a tendency of wearing thereby causing sliding of the pump jack down the pole to result in accidents. Additionally, as such spiral rod wears, it may have a tendency to snap outward thereby further causing additional accidents.

While heretofore pump jacks and pump jack poles were typically utilized in the installation of aluminum siding, such equipment can actually be utilized in other scaffolding needs. For example, in industrial or marine use, scaffolding is often required both internally and externally. In warehouses, where access to various layers of stored objects is required, the use of the pump jack and pump jack poles would be convenient. The platforming staging could be raised and lowered in order to reach the desired objects stored in the warehouse. Similarly, in marine applications, loading and unloading of ships, and other storage locations, could use the present pump jack and pump jack pole arrangement.

When utilizing the pump jack and pump jack pole for industrial use, however, additional strength would be needed for the pump jack in order to support the extra weight of the platforms required. Such extra strength is required not only in the construction of the pump jack itself, but in the operative portions thereof, including the shackles, the platform, etc.

Additional improvements are also warranted in connection with the rod utilized to roll down the pole. While typically spiral rods had been utilized for such purposes, such spiral rods tend to wear, are expensive to manufacture, and have been known to jam. Improvement would also be warranted in such areas as well.

Accordingly, while the aforementioned prior art patents have provided great improvement in the utilization of pump jacks and pump jack poles, additional features, modifications, and improvements are warranted in order to even further extend the use of such eqiupment into industrial and marine areas. Also, additional features are always warranted in order to improve the safety of such equipment.

SUMMARY OF THE INVENTION

Accordingly, it is an object of the present invention to provide improvements in the use of pump jacks and pump jack poles, in connection with scaffolding equipment.

Another object of the present invention is to provide improvements in the use of pump jacks and pump jack poles to extend their capabilities into the industrial and marine areas.

Still another object of the present invention is to provide an improved pump jack having a protective cover for the crank down portion of the pump jack in order to avoid hazzards upon wear of the roller.

Another object of the present invention is to provide an improved pump jack which includes a unique roller arrangement for lowering the pump jack down the pump jack pole.

Still another object of the present invention is to provide an improved pump jack constructed of channel members to provide greater strength and the use of the pump jack for industrial and marine purposes.

Another object of the present invention is to provide a pump jack having improved upper and lower shackle members in order to gain greater strength, improved efficiency, and more support.

Still a further object of the present invention is to provide an improved pump jack having a release lever with limited movement in order to restrict the release spacing of the lower shackle during riding down of the pump jack along the poles.

Briefly, in accordance with the present invention there is provided a pump jack arranged for traveling up and down a pole. The pump jack includes a frame member, with upper and lower shackle members supported on the frame member. A pump arm is pivotally coupled to the frame member for causing the shackle members to alternately grip the pole. The non-gripping shackle member is stepped upwardly along the pole while the other shackle grips the pole. A support arm projects from the pole for holding a weight such as a scaffold platform. A release lever is provided for disengaging the lower shackle from the pole while the upper shackle grips the pole. A handle connected to the upper shackle permits cranking down the pump jack along the pole.

In an embodiment of the invention there is provided a rod at the front end of the upper shackle for rolling down of the upper shackle on the pole. An L-shaped cover plate covers both the top and front of the rod to prevent accidental slippage of the pump jack on the pole should the rod wear.

The rod can be of various forms including a splined arrangement, a polyhedron, or octagonal arrangement, or simply a knurled outer surface. Additionally, it can be an inner rod with an outer sleeve. Furthermore, it can actually be a simple cylindrical shaft having a smooth exterior.

In an embodiment of the invention the upper and lower shackles are each formed of a clamping yoke portion which encircles the pole and includes a front and rear gripping rod. A linkage bracket is also provided. The linkage bracket in the case of the upper shackle is coupled to the pump arm. In the case of the lower shackle, the linkage bracket is coupled to the support arm. The linkage bracket is pivotally connected to the clamping yoke along the rear gripping rod. In this manner, the rear gripping rods serves both as the pivot between the clamping yoke and the linkage bracket as well as the part for gripping the rear portion of the pole.

The pump jack can also be formed of U-shaped channel members in order to improve its rigidity for industrial and marine use. The channel members can be interconnected to provide slidably adjustable support arms for the scaffolding sections. The channels can be mitered together in order to further improve their rigidity.

The aforementioned objects, features and advantates will, in part, be pointed out with particularity, and will, in part, become obvious from the following more detailed description of the invention, taken in conjunction with the accompanying drawings, which form an integral part thereof.

BRIEF DESCRIPTION OF THE DRAWINGS

In the drawings.

In the various figures of the drawing like reference characters designate like parts.

DESCRIPTION OF THE PREFERRED EMBODIMENT

Figure 1:
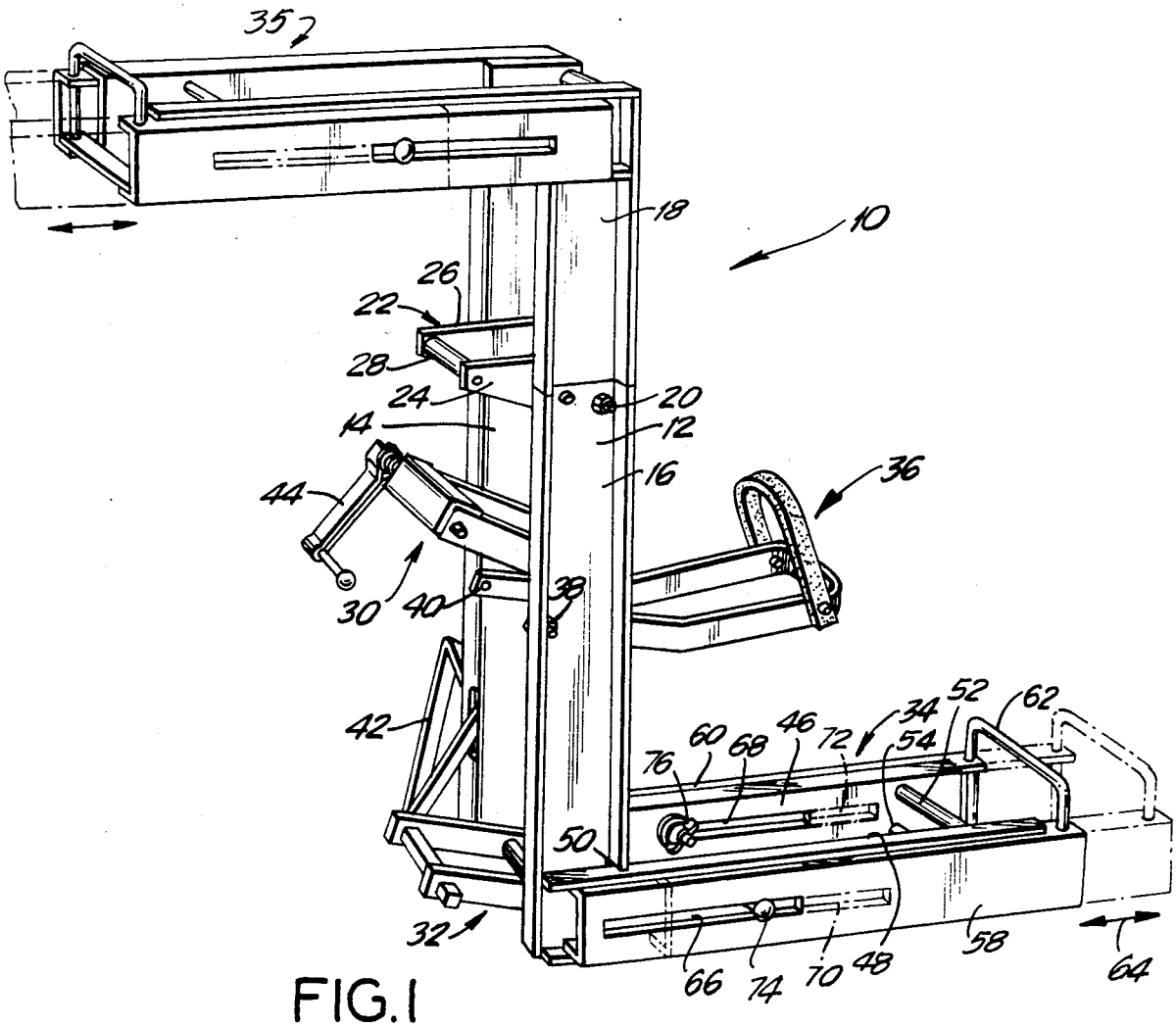
FIG. 1 is a perspective of an improved pump jack utilizing U-shaped channels to provide greater support and rigidity.

Referring now to FIG. 1, there is shown a pump jack, shown generally at 10, comprising a frame member having opposing pairs of vertical posts 12, 14. The vertical posts are shown as being formed of substantially U-shaped channels which are spaced apart and can straddle the pump jack pole. The particular channels are shown to include a lower section 16 and an upper section 18 which can be bolted together at 20. An upper spacing member 22 spaces apart the opposing side walls 12, 14. The spacing member 22 includes side plates 24, 26, with a front roller 28. A rear roller can also be included (not shown). The spacer 22 will straddle around the pole and maintain the jack vertical along the pole.

As is well known in the operation of a pump jack, there is provided an upper shackle member 30 and a lower shackle member 32. There is also provided a first support arm 34 projecting in one direction. A second support arm 35 is also shown at the upper end projecting in the opposing direction. A pump support arm 36 is utilized to control the pumping action for climbing up of the pump jack along the pump jack pole.

As is known within the pump jack art, the pump arm 36 is utilized to have the upper and lower shackles alternately grip onto the pole. The non-gripping shackle climbs up the pole.

In order to lower the pump jack down the pole, the release lever 42 pushes the lower shackle forward. The handle is then utilized to roll down the pump jack along the pump jack pole with the upper shackle gripping the pole during the rolling down operation.

Each of the upper and lower support arms 34, 35, are substantially identical. The arms are formed of opposing pairs of U-shaped channels 46, 48 which can be secured directly to the opposing vertical channels 12, 14. A lower portion of the vertical channels 12, 14 can be notched as shown at 50, in order to accommodate the horizontal support channels 46, 48.

Transverse spacer rods 52, 54 can be placed one above the other in order to maintain the ends of the channels 46, 48 spaced apart and securely held. These spacer rods 52, 54 can also serve to restrain any coupling bars that are utilized to hold scaffolding staging in place on the support arms.

A separate pair of U-shaped channels 58, 60 are inverted and slightly narrower than the first pair of channels 46, 48 so as to slidably fit within the opposing mouth formed by the first pair of channels 46, 48. The distal end of these outer channels 58, 60 are interconnected by a U-shaped handle 62 to faciitate sliding inward and outward of the outer channels 58, 60 as shown by the arrow 64.

An elongated pair of slots 66, 68 are formed in the outer channels 58, 60. A corresponding additional pair of elongated slots 70, 72 are formed on the inner channels 46, 48. Screws 74 with wing nuts 76 pass through the coaligned pairs of slots so as to lock the outer channels to the inner channels at the desired elongated position of the support arms. In this manner, the support arms can be extended outwardly to the position shown by the dotted line and moved inwardly to the position shown in the solid line. This permits accommodation of different widths of scaffolding platforms to be placed on the support arms.

By utilizing the U-shaped channels, additional strength or support is provided to the pump jack to permit its use for both industrial and marine purposes. Additionally, in the prior art pump jack arrangements, the support arms included a pivotal folding member for expanding the length of the support arm. Such pivotal support had a tendency of inwardly folding when placed against a support surface. Similarly, when a ladder was placed against such support arm, the ladder would tend to fold the support arms inwardly causing accidents.

By means of the use of the U-shaped channels, the elongated slots, with the clamping arrangement to permit extending the length of the support arms, such extensions are permitted without the possibility of having the support arms fold and collapse thereby causing accidents.

Figure 2:
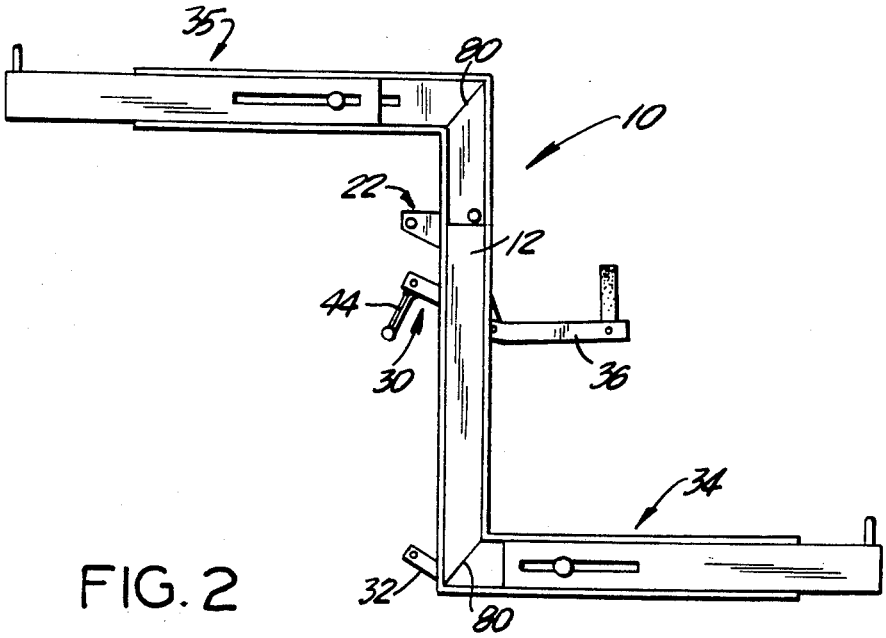
FIG. 2 is a side elevational view of the pump jack similar to that shown in FIG. 1, and showing the use of mitered edges between the various channel sections.

Referring now to FIG. 2, in order to achieve improved support, each of the support arms 34, 35, can be secured onto the vertical body sections 12, 14, by having the junctions mitered as shown at 80. The mitered edges provide the additional rigid support for the pump jack. As a result of the mitered edges, as weights are placed on the support arms, the twisting or bending moment normally provided by the interconnection of the type shown in FIG. 1 is avoided. The use of the mitered edges permits greater weight to be carried by the support without twisting of the support arms away from the frame.

Figure 3:
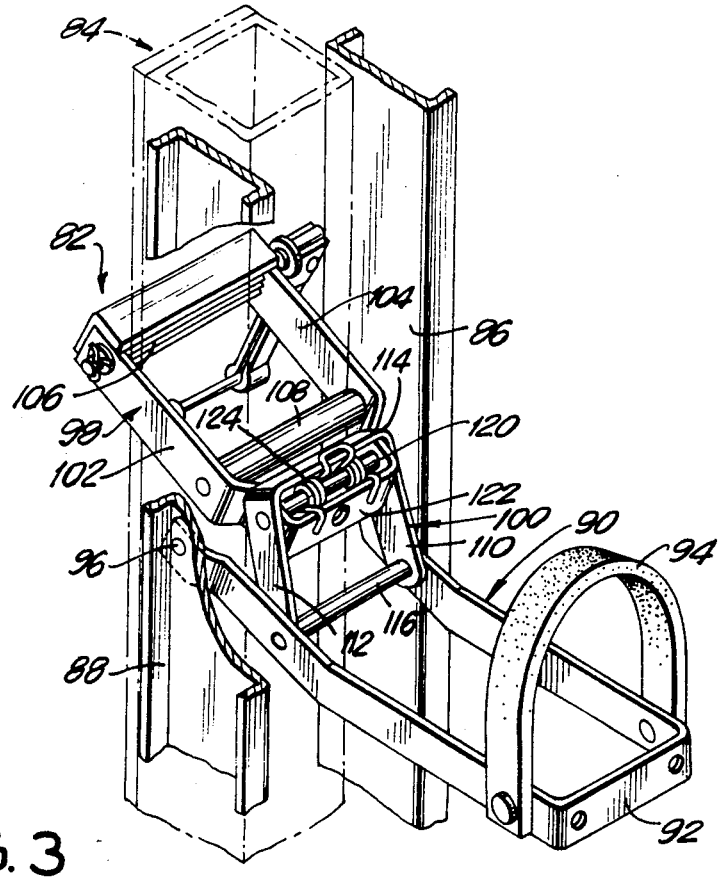
FIG. 3 is an exploded, partially cutaway, perspective view showing upper shackle member in accordance with the prior art within the improved pump jack of the present invention.
Figure 4:
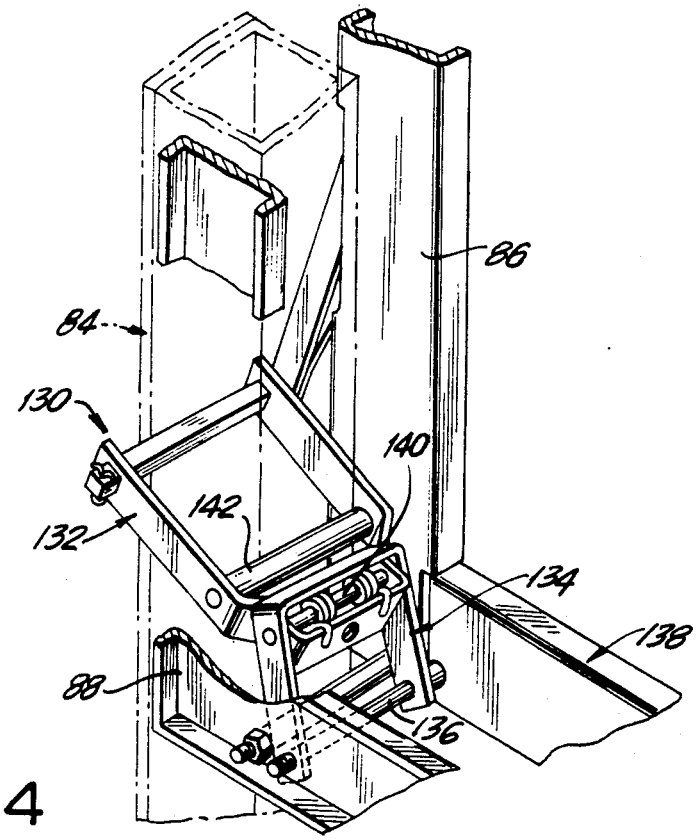
FIG. 4 is a perspective exploded view, partially broken away, showing lower shackle in accordance with the prior art within the improved pump jack of the present invention.

Referring now to FIGS. 3 and 4, there is shown the upper and lower shackle general construction that was heretofore utilized in prior art arrangements. FIG. 3, however, does includes the guard plate of the present invention. Specifically as shown in FIG. 3, the upper shackle, shown generally at 82, forms a substantially four sided yoke member in which the pole, shown in dotted lines at 84, would be inserted. The upper shackle itself 82 fits between the opposing side walls 86, 88 of the pump jack. The pump arm 90 was utilized to control the action of the upper shackle 82.

The pump arm 90 includes a substantially U-shaped member 92, having a stirrup 94 at its rearward distal end through which the foot of an operator could be placed. The forward distal ends of the pump arm are pivotally connected to the side walls of the pump jack by means of the pivot pins or rivets 96.

The upper shackle 82 comprises two members, the yoke member 98 and the linkage member 100. The yoke member 98 comprises a substantially U-shaped arrangement including side plates 102, 104 for straddling on either side of the pole, a forward gripping rod 106 and a rearward gripping rod 108.

The linkage member 100 is also of substantially U-shape formation including the opposing legs 110, 112 connected by a bight portion 114. A connecting rod 116 closes off the rear of the legs 110, 112 and pivots the linkage member 100 to the pump arm 90.

The two parts of the upper shackle 82, namely the yoke portion 98 and the linkage portion 100 are pivoted together along a pivot pin 120. The pivot pin spans the opposing legs 110 and 112 of the linkage member 100 and is also interconnected between a rearwardly directed narrow neck extension 122 which extends rearwardly from the rear clamping rod 108. A biasing spring 124 is wrapped around the pivot rod 120 to bias the yoke member 98 to the linkage member 100.

As shown in FIG. 4, the lower shackle member 130 is very similar to the upper shackle member 82 previously described. The lower shackle 130 again includes a yoke member 132 and a linkage member 134. The yoke member 132 surrounds the pole 84 and is spaced between the lateral sides 86, 88 of the pump jack. In this case, a connecting rod 136 interconnects the linkage member 134 with the support arm 138 projecting from the pump jack. It is again to be noted that the pivot rod 140 between the yoke member 132 and the linkage member 134 is spaced apart from the rear gripping rod 142 at the back of the yoke member 132. The operation of the upper and lower shackles is achieved as follows. The lower support arm 138 carries a weight whereby the lower shackle has its yoke member 132 griping the pole. The operator's foot is inserted into the stirrup 94 and the pump arm is moved upwardly. In doing so, the connecting rod 116 is moved outwardly in an arcuate fashion. As a result, the spring 124 causes the front and rear gripping rods of the yoke 98 of the upper shackle 82 to grip onto the pole.

As the operator presses down onto the pump arm, he shifts his weight from the support arm to the pump arm. This now applies pressure onto the upper shackle causing it to tightly grip onto the pole. The lower shackle, however, is slightly relieved from its gripping of the pole. Continued downward movement on the pump arm causes the entire pump jack to pivot about the rivet 96 thereby stepping upward of the pump jack along the pole, bringing upwardly the lower shackle.

Upon the release of the downward push on the pump arm 90, the operator again shifts his entire weight onto the lower support arm whereby again the lower shackle grips the pole. The upper shackle is thereby released. Upward movement of the pump arm causes the upper shackle to move upward until it again grips onto the pump jack pole.

Figure 5:
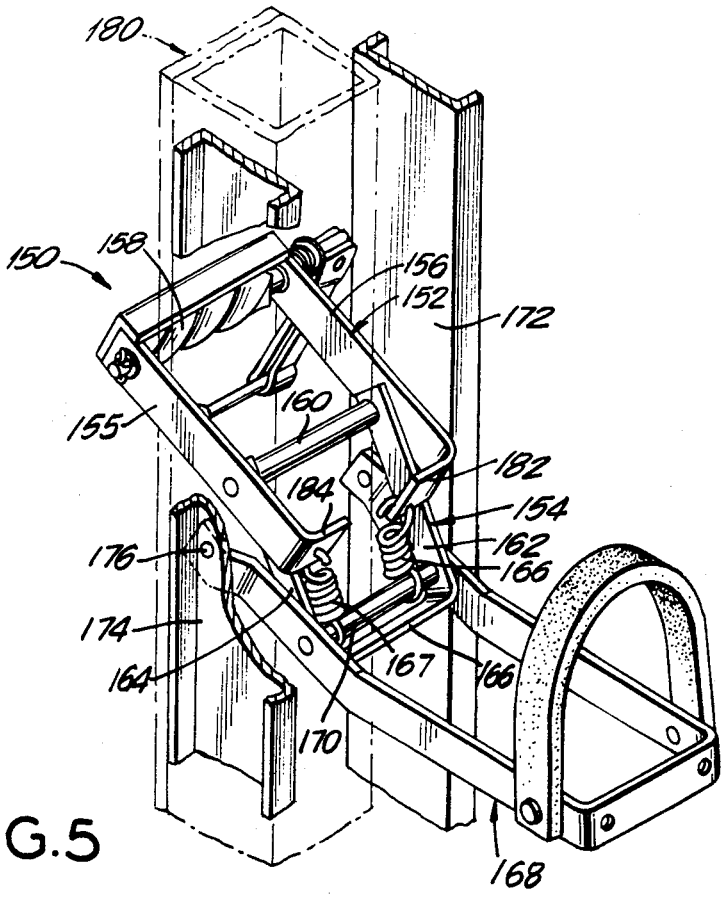
FIG. 5 is a view similar to that shown in FIG. 3, but showing the upper shackle in accordance with the present invention.
Figure 6:
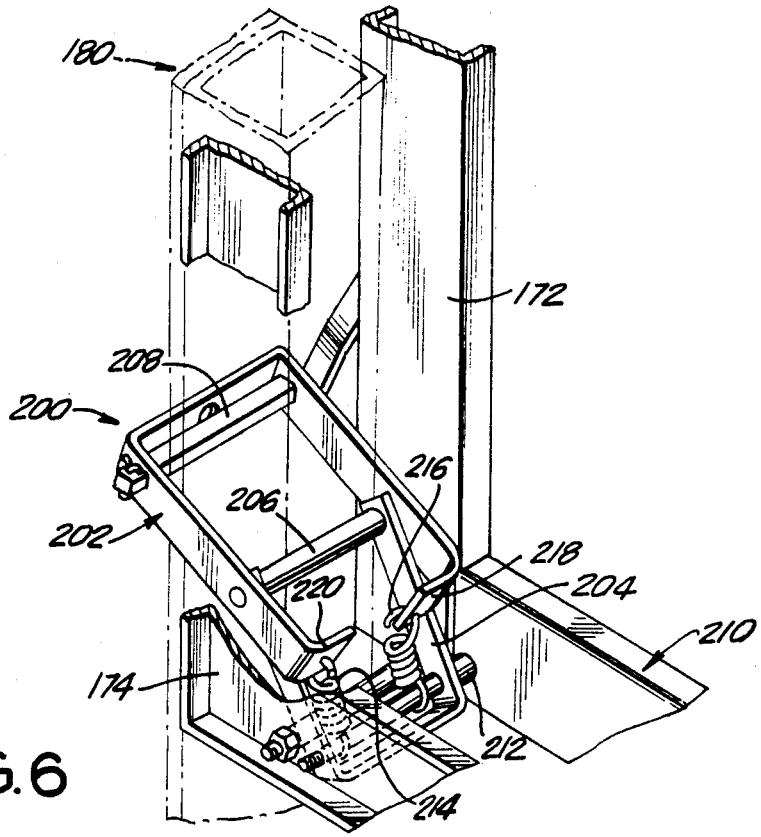
FIG. 6 is a view similar to that shown in FIG. 4, but showing the lower shackle in accordance with the present invention.

Referring now to FIGS. 5 and 6, there is shown the improved upper and lower shackles of the present invention. Specifically, as shown in FIG. 5, the upper shackle 150 again includes a yoke member 152 and a linkage member 154. The yoke member 152 includes the opposing side plates 155, 156, the forward gripping roller 158 and the rear gripping roller 160. The linkage member 154 is formed of a U-shaped member having opposing side legs 162, 164 and a rear connecting bight plate 166.

The rear of the linkage member 154 is pivotally connected to the pump arm 168 by means of the connecting bar 170. The pump arm 168, in turn, is pivotally connected between the side walls 172, 174 of the pump jack by means of the pivot pin 176. The pole 180 passes through the yoke member 152.

It should be noted, that in the present arrangement, the yoke member 152 and the linkage member 154 are pivoted together about the rear gripping rod 160. Accordingly, the same rear gripping rod serves both for gripping of the pole and also as the pivot about which the two parts of the upper shackle move with respect to each other.

This arrangement should be contrasted with the prior art arrangement of FIG. 3 where two separate rods were provided. The rear gripping rod 108 was separate and apart and in fact spaced fowardly from the pivot rod 120 interconnecting the two parts of the upper shackle.

The spring biasing arrangement between the two parts of the shackle are provided by means of including inwardly directed ears 182, 184 extending from the distal ends of the opposing sides 155, 156 of the yoke member. The springs themselves 166, 168 are tension springs connected between the ears 182, 184 and the connecting rod 170.

It should also be noted that the rear gripping rod 160 is positioned medially along the length of the opposing side plates 155, 156 of the yoke member.

FIG. 6 shows the improved embodiment of the lower shackle including the same concept as shown with regard to the upper shackle. Specifically, the lower shackle 200 is shown to include a yoke member 202 and a linkage member 204. Again the two are pivoted together along the pivot rod 206 which simultaneously serves as the rear gripping rod of the yoke member 202. The foward gripping rod 208 is also provided at the front end of the yoke member 202.

In the case of the lower shackle, the distal end of the linkage member 204 is connected to the support arm 210 by means of the connecting rod 212. Again, spring biasing is provided by means of the tension springs 214, 216 extending between the inwardly directed ears 218, 220 at the distal ends of the yoke member and the connecting rods 212. The pole 180 would extend within the yoke member.

Again, it should be noted that in the improved version of the lower shackle shown in FIG. 6, the same rod 206 serves simultaneously as the rear gripping rod as well as the pivot rod between the yoke portion and the linkage portion of the lower shackle. This is contrasted with the two spaced apart rods serving this purpose namely 142 and 140, as shown in the prior art of FIG. 4.

By utilizing the common rod for both the pivot and the rear clamping, it has been found that the present pump jack can actually maintain a greater strength and provide more support for heavier loads. This can best be explained by the fact that in the prior art, by spacing the pivot rod from the rear gripping rod, there was a transfer of force from one to the other and thereby a loss of some of the force for supporting purposes. Namely, the force provided by the pumping action was applied to the linkage. The linkage applied such force to the pivot pin. In this manner, it transferred the force to the yoke member. However, since the pivot was spaced from the gripping part of the yoke, there was a loss of some of the force and thereby less support could be provided. This was both in the upper and lower shackles.

In the present embodiments, the force is transferred through the pivot. However, that same pivot serves as the direct part of the gripping action. Therefore, all of the force applied through the pumping is utilized for gripping and thereby greater support can be provided for heavier loads.

By means of the present arrangement, it has been found that we achieve a greater mechanical advantage than in the prior art. There is a more positive direct locking force applied since there is no transfer between the pivot pin and the gripping rods. Additionally, there has been found less slip because of the present design. Such reduced slippage produces greater safety, more efficiency, and the ability to support greater loads.

In addition, the spring arrangements that are provided give improvement over the prior art spring arrangements. Our springs are spaced from the pivot and provide a greater mechanical advantage in biasing the yoke member with respect to the linkage member.

Accordingly, with the present design, the shackles lock onto the pump jack poles with more grip. It also achieves greater lifting power because of the improved leverage principals. The vortex angle of the present design arrangement is much closer to 90 degrees. Also, the new focal point achieves a greater mechanical advantage without the normal loss previously encountered in the transference of force.

Figure 7:
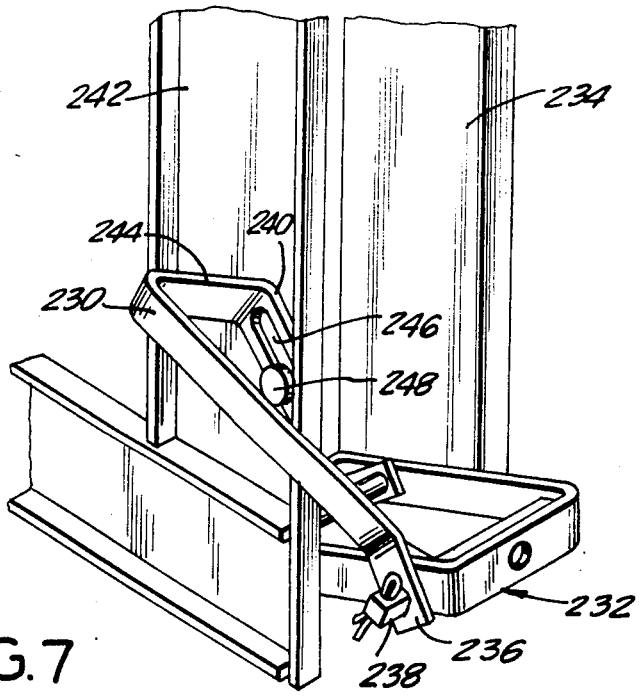
FIG. 7 is a partially broken away perspective view of the release lever in accordance with the present invention for releasing the lower shackle member.

Returning now to FIG. 7, an additional feature of the present pump jack is shown. As described in the aforementioned U.S. Pat. No. 4,463,828, a release lever 230 is provided to release the lower shackle member 232 from its gripping onto the pump jack pole in order to permit rolling down of the pump jack 234 along the pole. Such release lever includes a forward arm 236 which is connected onto the front gripping rod 238 of the lower shackle 232. A body portion 240 is slidably connected with respect to a side wall 242 of the pump jack 234. An inwardly directed foot pedal 244 is provided to permit the operator to use his foot in order to release the lower shackle from its gripping engagement.

In the present embodiment, the body portion 240 includes an elongated slot 246. A pin or rivet 248 having an enlarged head is secured to the side wall 242 of the pump jack so as to slidably engage the elongated slot 246.

With this arrangement, the forward movement of the release arm is limited to only permit the lower shackle slight movement forward of the pump jack pole. Such movement is limited by the length of the elongated slot and thereby easily controlled.

By making the slot 246 of minimal length, the amount of forward movement of the release lever is limited. As a result, the lower shackle is restricted to only approximately ¼ inch–½ inch forward of the pump jack pole. In the prior art such movement permitted forward projection of the lower shackle to approximately 2 inches forward of the pump jack pole. The reduction in the movement and thereby limiting of the spacing between the shackle and the pole eliminates the possibility of having the lower shackle remaining unintentionally open. Also, the braking reaction time is now approximately five times faster.

Generally, in the present embodiments, the shackle spacing is restricted with respect to the pole size. As such, the size of the shackle opening can be limited to only approximately ¼ inch greater than the pole size. In this manner, the shackles maintain an almost horizontal position with respect to the pump jack pole. This improves the gripping action of the shackles with respect to the pump jack pole and permits greater support by the pump jack.

Figure 8:
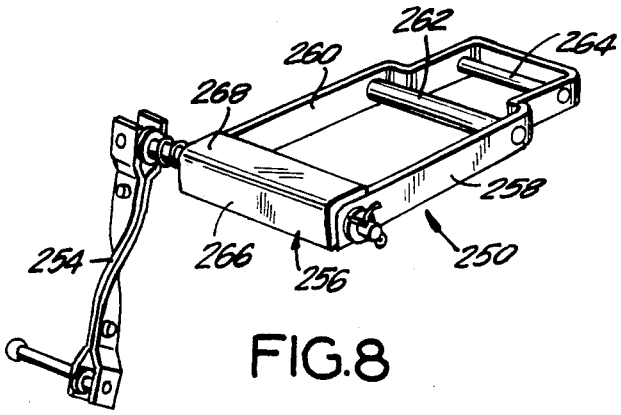
FIG. 8 is a perspective view of a portion of the upper shackle employing the cover guard for protecting the front gripping rod.
Figure 9:
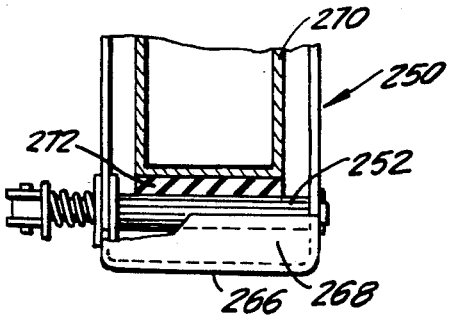
FIG. 9 is a partially broken away top sectional view of the guard shown in FIG. 8.

Referring now to FIGS. 8 and 9, there is provided yet another safety feature in the present invention. As previously described, the pump jack includes an upper shackle member, shown as 250 which has a forward roller 252 to which is connected a handle 254. The handle can be an over-the-center spring loaded handle, as described in the aforementioned U.S. patent. By winding the handle, the roller 252 is used to ride the pump jack down the pole. However, in the prior art, the roller 252 had a tendency of wearing, and can even split. In doing so, it will strike outward and may harm the worker. Also, it may cuase the pump jack to slide down the pole.

As shown in FIGS. 8 and 9, there is provided a guard plate shown generally at 256, across the top and front of the roller to prevent such accidents. More specifically, there is shown the upper shackle 250 formed of substantially U-shaped configuration having opposing sides 258, 260. The rear gripping rod 262 is shown connected near the rear end. The specific shackle shown is that of the prior art and accordingly includes a spaced apart pivot pin 264.

At the forward end of the shackle is provided the forward gripping rod 252. The rod is covered by means of the guard plate 256 which includes the front wall 266 and the top wall 268. The wall extends between the opposing arms 258, 260 of the upper shackle 250. The shackle would thus fit around the pole 270. The particular pole shown is of the type described in the aforementioned U.S. patent and includes the rubberized front covering 272. The gripping rod 252 therefore rolls along and bites into the rubberized surface 272.

Typically, the front gripping rod 252 includes a number of ridges in order to permit it to bite into the surface of the pump jack pole. In the past, the ridges were provided by means of a spiral or helical formation on the surface of the rod. While such helical rod adequately serves the purpose of rolling down the pole, it has been found that additional benefits can be provided by means of other arrangements. The reason is that the helical rod has been found to cause a torque with one end generally being under greater tension than the other. The rod therefore tends to slightly angle and thereby provides an uneven gripping of the pole. As a result, the pump jack has a tendency to tip to one side. Additionally, with the spiral arrangement, there is greater wear since the spiral tends to stretch as the handle operates the spiral rod.

Figure 10A:
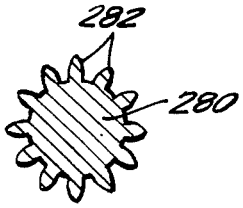
FIGS. 10A, 10B, 10C, and 10D show cross sectional views through front gripping rollers in the upper shackle member.
Figure 10B:
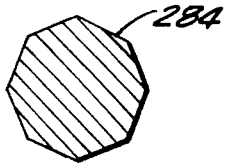

In order to eliminate these problems, applicant has provided additional arrangements. For example, as shown in FIG. 10A there is shown a roller 280 having a solid core and a splined arrangement including the longitudinally projecting prongs 282. As shown in FIG. 10B, the roller can also be of octagonal shape shown in 284. Such arrangements avoid the uneven torque, reduces wear, and reduces slippage.

Figure 10C:
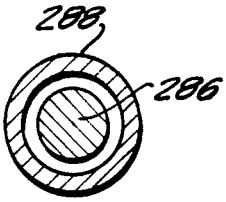

Applicant has also found, that it is possible to provide a roller shown in FIG. 10C including a center shaft 286 with an outer sleeve 288 having an inside diameter which is spaced from the outside diameter of the roller. Furthermore, applicant has even found that a solid cylindrical shaft 290, as shown in FIG. 10B can also be utilized.

The use of such simplified formations for the front gripping member heretofore had been considered unsuitable. Since it was thought that the front gripping member actually has to bite into the surface, it was felt that grooves, ridges, or as in the prior art, the spiraled arrangement, was a necessity. This was felt to be a requirement, especially since the front roller was used to grip the pole during the rolling down of the pump jack along the pole.

Figure 10D:
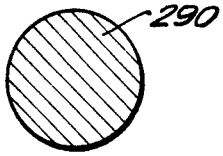

Nevertheless, applicant has found that even utilizing the simple cylindrical smooth round pole of FIG. 10D, adequate gripping can be provided. Such gripping can even be provided on a wooden pole, and has even been tested with an oil slick covering on the wooden pole. Still, sufficient compression of the wood occurs because of the gripping action to permit rolling down of the pump jack along the pole. Furthermore, it has been found that the present arrangement provides a self stopping action. If the pole is too thin, the shackle will not even climb up the pole. Accordingly, since the pump jack will not climb up a smaller pole, there is no problem of fearing that the pump jack will accidentally slip or slide down the pole. If the pump jack can never climb up the pole, there is no worry about its sliding down the pole. By providing the approximate ¼ inch spacing as heretofore described with regard to the shackle and the pump jack pole, it has been found that adequate compression of the pole takes place to permit gripping of the pole even without having any ridged surface along the gripping rod.

There has been described heretofore the best embodiment of the invention presently contemplated. However, it is to be understood that various changes and modifications may be made thereto without departing from the spirit of the invention.

I claim:

1. A pump jack arranged for traveling up and down a pole comprising:

a frame member, upper and lower shackle members supported by said frame member, a pump arm pivotally coupled to said frame member for causing said shackle members to alternately grip the pole with the non-gripping shackle member being stepped upwardly along the pole, said upper shackle comprising a substantially U-shaped yolk having a rod means at its front end, release means for disengaging the lower shackle from the pole while the upper shackle grips the pole, handle means for cranking said rod means along the surface of the pole and compressing the pole to provide a grip to ride the pump jack down the pole, and an L-shaped safety cover plate secured to opposing side arms of said yolk covering the top and front of the rod means to prevent accidental slippage of the jack on the pole should the rod wear.

2. A pump jack as in claim 1, wherein said rod means comprises a splined rod.

3. A pump jack as in claim 1, wherein said rod means comprises a polyhedron in cross section.

4. A pump jack as in claim 1, wherein said rod means comprises an octogon in cross section.

5. A pump jack as in claim 1, wherein said rod means comprises a smooth cylindrical roller.

6. A pump jack as in claim 1, wherein said rod means comprises a center cylindrical shaft, and a surrounding sleeve.

7. A pump jack as in claim 1, wherein said upper shackle is slightly angled but approximates a horizontal plane.

8. A pump jack as in claim 1, wherein the front to back spacing of the upper shackle is approximately ¼ inch greater than the pole size.

9. A pump jack as in claim 1, wherein said upper shackle comprises a pair of opposing side arms, said rod means extending through aligned apertures in the distal ends of said side arms and laterally projecting from said side arms, said handle means coupled to one projecting end of said rod means, and wherein said rod means has a ridged surface only in the portion between said side arms.

10. A pump jack as in claim 1, wherein said lower shackle comprises a substantially U-shaped yoke for embracing the pole, a forward gripping rod secured at the front end of said yoke and having a substantially square cross section, and a pair of aligned circular apertures at the distal ends of said yoke for receiving the lateral ends of said gripping rod.

11. A pump jack arranged for traveling up and down a pole, comprising a frame member, weight support members including an upper pump arm pivotally coupled to said frame member and a support arm fixedly projecting from said frame member, upper and lower shackle members pivotally connected to their respective weight support members, said pump arm causing said shackle members to alternately grip the pole with the non-gripping shackle member being stepped upwardly along the pole, each shackle member comprising a clamping yoke encircling the pole and including front and rear gripping rods, and linkage brackets directly connected between the clamping yoke and the weight support member for transferring a clamping force from the weight support member to the clamping yoke, both the clamping yoke and the linkage bracket pivotally moving toward and away from each other during travel along the pole, said rear gripping rod directly connected to both the clamping yoke and the linkage bracket whereby the clamping yoke and the linkage bracket are pivotally connected by said rear gripping rod which serves the dual functions of gripping the pole and pivotally connecting the clamping yoke and the linkage bracket.

12. A pump jack as in claim 11, wherein said clamping yoke extends rearwardly beyond said gripping rod, and comprising spring means for biasing the rear of the clamping yoke to the connected end of the linkage bracket.

13. A pump jack as in claim 11, and further comprising a release means for disengaging the lower shackle member from the pole to lower the pump jack down the pole, said release means comprising an elongated rod having its lower end coupled to the front end of the lower shackle member, a body portion slidably adjacent to the frame member, and upper and lower limiting stop means along the body portion to limit the stroke of the release means.

14. A pump jack as in claim 11, wherein said clamping yoke comprises a substantially U-shaped member having a pair of opposing legs for straddling the pole and a front bight portion, the front gripping rod extending between said opposing legs, slightly rearward of said front bight portion, and the rear gripping rod extending between said opposing legs medially along their length.

15. A pump jack as in claim 14, wherein said linkage bracket comprises a substantially U-shaped member having a pair of opposing arms, said gripping rod directly connected between the distal ends of said opposing arms, and a connecting rear bight portion interconnecting said arms, and comprising a connecting rod slightly forward of said rear bight portion for connecting the linkage bracket to its weight support member.

16. A pump jack as in claim 15, and comprising a pair of ears inwardly directed from the distal ends of said legs, and tension springs coupled between said connecting rod and said ears.

17. A pump jack arrangement for traveling up and down a pole, comprising, a frame member, upper and lower shackle members supported by said frame member, a pump arm pivotally coupled to said frame member for causing said shackle member to alternately grip the pole with the non-gripping shackle member being stepped upwardly along the pole, said upper shackle having rod means at its front end, handle means for cranking said rod means to ride the pump jack down the pole, and wherein said frame member comprises a pair of outwardly opened, laterally opposing frame U-shaped channels coupled together in spaced apart relationship for straddling the pole, a platform support extending from said frame member and comprising a first pair of outwardly opened, laterally opposing U-shaped channels projecting respectively from the frame channels, spacer rods extending between said first pair of channels, a second pair of U-shaped channels inwardly opened and slidably received respectively within said first pair of channels, to permit slidable adjustment of the length of said platform support, opposing elongated slots formed in at least one of said first and second pairs of channels, adjustable clamping members passing through said elongated slots to lock first and second pairs of channels at the desired length, and a handle bar interconnecting the distal ends of said second pair of channels to adjust the extended length of said platform support.

18. A pump jack as in claim 17, and comprising a first platform support projecting in a first direction from one distal end of said frame member, and a second platform support projecting in an opposing direction from the other distal end of said frame member.

19. A pump jack as in claim 17, and comprising opposing staggered elongated slots formed respectively in both said first and second pairs of channels.

20. A pump jack as in claim 17, wherein the junction between said frame member channels and said first pair of channels are mitered together.

* * * * *